US010954051B1

(12) United States Patent
Vanderpan et al.

(10) Patent No.: US 10,954,051 B1
(45) Date of Patent: Mar. 23, 2021

(54) ITEM PROTECTION DEVICE AND METHOD FOR USE

(71) Applicant: DOORFRAMER, INC., Lincoln, CA (US)

(72) Inventors: Dave Vanderpan, Lincoln, CA (US); Del Vanderpan, Lincoln, CA (US)

(73) Assignee: DOORFRAMER, INC., Lincoln, CA (US)

( * ) Notice: Subject to any disclaimer, the term of this patent is extended or adjusted under 35 U.S.C. 154(b) by 0 days.

(21) Appl. No.: 16/200,555

(22) Filed: Nov. 26, 2018

Related U.S. Application Data

(60) Provisional application No. 62/591,616, filed on Nov. 28, 2017.

(51) Int. Cl.
*B65D 81/05* (2006.01)
*B65D 85/48* (2006.01)

(52) U.S. Cl.
CPC ..... *B65D 81/054* (2013.01); *B65D 85/48* (2013.01)

(58) Field of Classification Search
CPC .. B65D 81/054; B65D 81/057; B65D 81/055; B65D 81/053; B65D 81/05; B65D 85/48; B65D 25/107
USPC ..... 206/586, 453, 587
See application file for complete search history.

(56) References Cited

U.S. PATENT DOCUMENTS 1,316,467 A 9/1919 Tollis
1,376,686 A 5/1921 Fleckner
1,667,279 A 4/1928 Allen
1,886,531 A 11/1932 Dalchow
2,462,442 A 2/1949 Wallace
2,489,029 A 11/1949 Guerrant
2,742,146 A 4/1956 Lester, Jr.
2,844,913 A 7/1958 Brill, Jr.
2,887,219 A 5/1959 Lester, Jr.
2,903,823 A 9/1959 Westford
2,929,495 A 3/1960 Simonsen
2,931,603 A 4/1960 Johnston et al.
3,017,022 A 1/1962 Amundson
3,111,724 A 11/1963 Piekarski
3,205,982 A 9/1965 Chimienti
3,301,820 A 1/1967 Haendiges
3,593,458 A 7/1971 Wahlfeld et al.
3,618,261 A 11/1971 Torbetter
3,668,906 A 6/1972 Josephart
3,739,525 A 6/1973 Rybak
3,800,365 A 4/1974 Bruggart
3,807,622 A * 4/1974 Belcher ..... B65D 81/133 206/421

(Continued)

FOREIGN PATENT DOCUMENTS

CA 568764 1/1959
DE 101266 C 10/1897

(Continued)

*Primary Examiner* — Steven A. Reynolds
(74) *Attorney, Agent, or Firm* — DLA Piper LLP (US)

(57) ABSTRACT

An item protection device protects the item during shipping, movement or installation. In one embodiment, the item may be a window unit whose corners are protected during shipping, movement or installation. The item protection device may have a locking mechanism that securely locks the item protection device to the item so that the item protection device is not easily knocked off of the item during shipping, movement or installation.

8 Claims, 8 Drawing Sheets

(56) References Cited

U.S. PATENT DOCUMENTS

| | | | | | |
|---|---|---|---|---|---|
| 3,868,054 | A * | 2/1975 | Congleton | B65D 85/52 | 206/521.1 |
| 3,893,647 | A | 7/1975 | Kennedy | | |
| 3,983,602 | A | 10/1976 | Barry | | |
| 3,987,956 | A * | 10/1976 | Congleton | A01G 9/0295 | 229/120.07 |
| 3,992,810 | A * | 11/1976 | Kimball | A01G 9/0295 | 47/77 |
| 4,024,604 | A | 5/1977 | Klimek et al. | | |
| 4,050,187 | A | 9/1977 | Geiger et al. | | |
| 4,099,299 | A | 7/1978 | Bruggert et al. | | |
| 4,176,494 | A | 12/1979 | Boucher et al. | | |
| 4,201,013 | A | 5/1980 | Robbins | | |
| 4,483,101 | A | 11/1984 | Berzina | | |
| 4,518,279 | A | 5/1985 | Suttles | | |
| 4,615,140 | A | 10/1986 | Frano | | |
| 4,620,389 | A | 11/1986 | Coulson | | |
| 4,635,886 | A | 1/1987 | Santucci et al. | | |
| 4,636,105 | A | 1/1987 | Johansson | | |
| 4,709,889 | A | 12/1987 | Erickson | | |
| 4,718,195 | A | 1/1988 | Ortega | | |
| D307,078 | S | 4/1990 | Guillement | | |
| 4,922,654 | A | 5/1990 | Hawke | | |
| 4,942,704 | A | 7/1990 | King | | |
| D319,007 | S | 8/1991 | Rogers et al. | | |
| 5,052,086 | A | 10/1991 | Nasuno | | |
| 5,054,613 | A | 10/1991 | Johansson | | |
| 5,056,198 | A | 10/1991 | Viglione | | |
| 5,159,782 | A | 11/1992 | Sales | | |
| 5,167,091 | A | 12/1992 | Schroeder | | |
| 5,209,017 | A | 5/1993 | Ridge | | |
| 5,210,973 | A | 5/1993 | Kratky et al. | | |
| 5,255,727 | A | 10/1993 | Saruwatari et al. | | |
| 5,312,078 | A | 5/1994 | Marsh | | |
| 5,358,423 | A | 10/1994 | Burkhard et al. | | |
| 5,365,697 | A | 11/1994 | Vanderpan | | |
| 5,463,189 | A | 10/1995 | Deneke et al. | | |
| 5,473,839 | A | 12/1995 | Stidham | | |
| 5,474,268 | A | 12/1995 | Yu | | |
| 5,542,209 | A | 8/1996 | Sheu | | |
| 5,562,315 | A | 10/1996 | Sales | | |
| 5,565,254 | A | 10/1996 | Norvell | | |
| 5,603,403 | A | 2/1997 | Sather | | |
| 5,617,672 | A | 4/1997 | Garrett | | |
| 5,635,697 | A | 6/1997 | Shellhammer et al. | | |
| 5,655,332 | A | 8/1997 | Papadopoulos | | |
| 5,722,203 | A | 3/1998 | Staples et al. | | |
| 5,787,639 | A | 8/1998 | Lamore | | |
| 5,806,683 | A * | 9/1998 | Gale | B65D 81/025 | 206/587 |
| 5,819,374 | A | 10/1998 | Chiles et al. | | |
| 5,857,429 | A | 1/1999 | Hostetler | | |
| 5,863,471 | A | 1/1999 | Stanek | | |
| 5,924,259 | A | 7/1999 | Marousek | | |
| 6,029,410 | A | 2/2000 | Westberg, II et al. | | |
| D427,894 | S | 7/2000 | Benz et al. | | |
| 6,142,304 | A * | 11/2000 | Moren | B65D 25/107 | 206/454 |
| 6,170,198 | B1 | 1/2001 | Staples et al. | | |
| 6,276,526 | B1 | 8/2001 | Miller et al. | | |
| 6,301,828 | B1 | 10/2001 | Vanderpan | | |
| 6,343,772 | B1 | 2/2002 | Oi | | |
| 6,357,181 | B1 | 3/2002 | Triemstra | | |
| 6,357,200 | B1 | 3/2002 | Vanderpan | | |
| 6,378,175 | B1 | 4/2002 | Vanderpan | | |
| 6,443,401 | B1 | 9/2002 | Vanderpan | | |
| 6,470,637 | B2 | 10/2002 | Gratz | | |
| 6,488,247 | B1 | 12/2002 | Gonzalez | | |
| 6,532,704 | B2 | 3/2003 | Hart | | |
| 6,725,604 | B1 | 4/2004 | Vanderpan | | |
| 6,840,381 | B2 * | 1/2005 | Stephens | B65D 25/107 | 206/589 |
| 6,968,954 | B2 * | 11/2005 | Hsieh | B65D 81/133 | 206/586 |
| 7,213,371 | B1 | 5/2007 | Vanderpan et al. | | |
| 7,743,922 | B2 * | 6/2010 | Pitt | B65D 81/055 | 206/521 |
| 8,662,307 | B2 * | 3/2014 | Pitt | B65D 81/055 | 206/521 |
| 2001/0042813 | A1 | 11/2001 | Taylor | | |
| 2004/0060241 | A1 | 4/2004 | Staples et al. | | |
| 2006/0243636 | A1 * | 11/2006 | Robichaud | B65D 81/056 | 206/586 |
| 2011/0233099 | A1 * | 9/2011 | Pitt | B65D 81/055 | 206/521 |

FOREIGN PATENT DOCUMENTS

| | | | |
|---|---|---|---|
| DE | 392148 | C | 3/1924 |
| DE | 823064 | C | 11/1951 |
| FR | 2232988 | A1 | 1/1975 |
| FR | 2247157 | A2 | 5/1975 |
| JP | H0667786 | A | 3/1994 |
| SU | 1464965 | A1 | 3/1989 |
| WO | WO9925172 | A1 | 5/1999 |

* cited by examiner

ITEM PROTECTION DEVICE AND METHOD FOR USE

PRIORITY CLAIMS/RELATED APPLICATIONS

This application claims the benefit under 35 USC 119(e) to U.S. Provisional Patent Application Ser. No. 62/591,616 filed Nov. 28, 2017 and entitled "Item Protection Device and Method for Use", the entirety of which is incorporated herein by reference.

FIELD

The disclosure relates generally to a device for protecting an item during shipping and installation and a method for using the device the item and in particular to a device for protecting a window or any cornered unit during shipping, movement or installation.

BACKGROUND

When a new building is built, whether residential or commercial, the building typically has one or more windows that are placed into the walls of the building. These new windows are manufactured by various window unit manufacturers and shipped to the construction site for installation. Each window unit includes a glass or plexiglass that forms the panes of the window and a frame of the window pre-assembled with various materials to include wood, vinyl, plastic, metal or other composites. During the shipping of the window units to the constructions site and handling of the window units at the constructions site (or at a shipping location), it is very possible for the window units to become damaged rendering them unusable. This damages of the window units is problematic for the general contractor at the construction site since another window units must be ordered and delivered and also problematic for the window manufacturer who may need to replace the window at no cost. In addition to new constructions projects, the same issue with damaged window units exists with replacement window units in which a person, such as a general contractor, is replacing current window units in a building with replacement window units.

In both cases, it is desirable to be able to protect the window unit during shipping and installation to reduce the damage. Currently, there are a number of products on the market that protect the window unit during shipping and installation. These products are generally comprised of scrap wood blocks, cardboard, Styrofoam, or plastic blocks that attach to the sides of a window unit hoping to prevent damage to the window unit during shipping and installation. The problems with these existing blocks are: 1) the blocks do not adequately protect the corner of the window unit; 2) different types of blocks may be required for a corner, bottom or a side of the window unit, 3) the material degrades during transportation, 4) the material and cost to apply it are cost-prohibitive and 5) the blocks or material may be knocked off of the window unit during shipping or installation resulting in a greater possibility of damage to the window unit. Thus, it is desirable to provide a window unit protection device and method for use that overcomes the above problems and limitations of the conventional window protection blocks and it is to this end that the disclosure is directed.

DETAILED DESCRIPTION OF ONE OR MORE EMBODIMENTS

The disclosure is particularly applicable to a window unit protection device and method for use and it is in this context that the disclosure will be described. It will be appreciated, however, that the device may be used for both new window units and replacement window units in which the window unit has one or more panes of glass or other material, a frame around the panes and some mechanism by which the window unit may be secured to a new building or an existing building. Furthermore, the window unit protection device may have a slightly different configuration for each different window unit manufacturer since the window unit made by each window unit manufacturer may have slightly different dimensions, angles (i.e. square, hexagon, etc.), features, etc. and the window unit protection device may be easily modified to accommodate the different window units for the different window unit manufacturers. Furthermore, the device may be easily modified so that the protection device may be used to protect other items during shipping, installation or movement of the item. For example, the protection device may be modified for use with a consumer or commercial appliance device wherein it is being moved and/or protected from one location to another (e.g., stove, refrigerator, dishwasher, crate, box, furniture, etc.), a motor assembly or any other item in which it is desirable to be able to protect the item during the shipping, movement or installation of the item.

Figure 1:
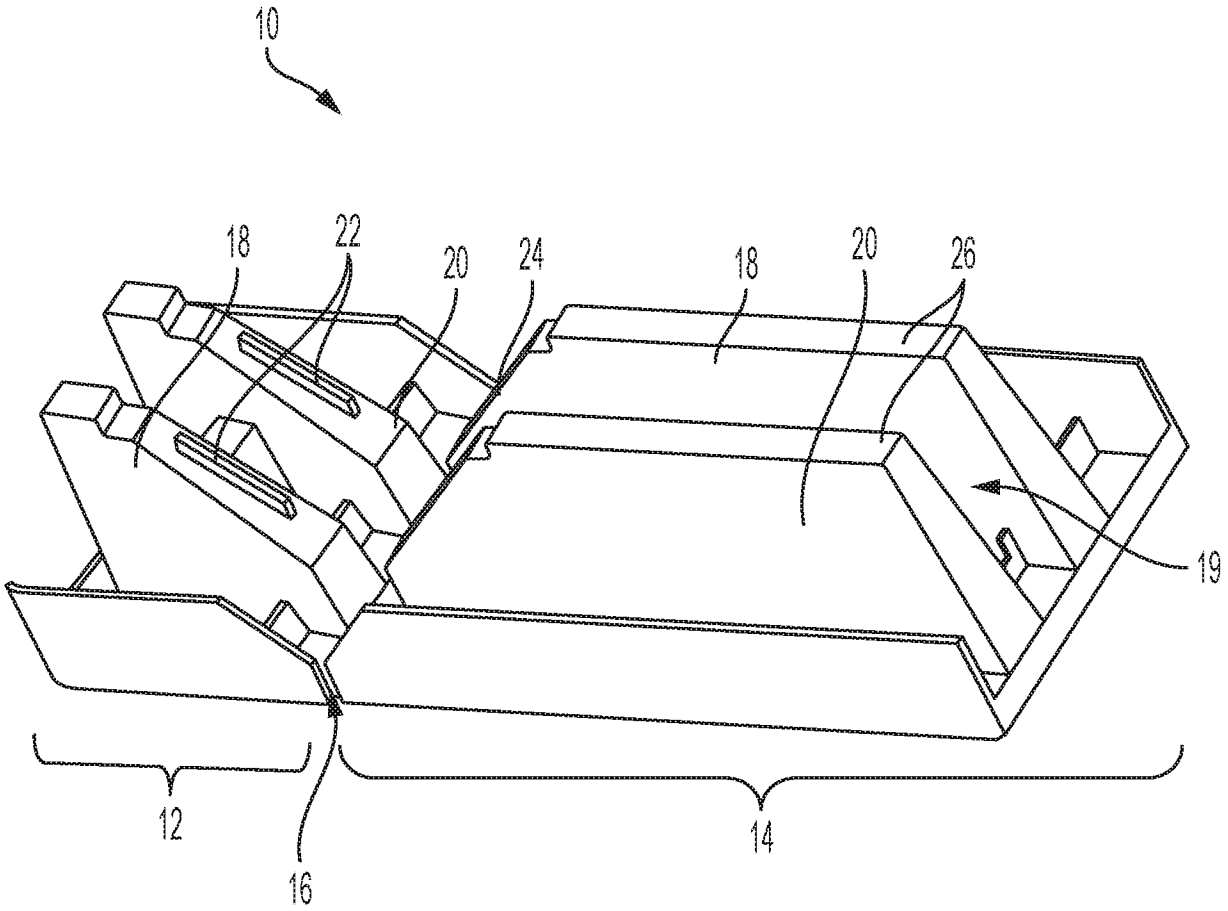
FIG. 1 illustrates an item protection device.

FIG. 1 illustrates an item protection device 10. The item protection device 10, in one illustrative embodiment described below, may be used to protect a window unit from damage during shipping, storage, moving and installation. The item protection device 10 may have a first portion 12 and a second portion 14 in varying lengths that are connected to each other by a hinge portion 16. The hinge portion 16 may be moved easily in one direction to fold the first and second portions 12, 14 towards each other when the item protection device 10 is going to be used to protect a corner region. The hinge portion 16 may also be manufactured so that the hinge portion 16 may be broken when moved in the opposite direction (the first and second portions 12, 14 away from each other) so that the first portion 12 or the second portion 14 may be used separately, such as for a flat surface of the item to be protected.

To protect a corner region, the first and second portions 12, 14 of the item protection device 10 may be folded towards each other at a prescribed angle of 0-180 degrees depending on the contour of the product to protect a corner of an item such as a window unit. Alternatively, the item protection device 10 may remain flat and may be used to protect a flat surface of the item so that the item protection device 10 may be used for both flat surfaces and corners of the item being protected. Since the item protection device 10 may be manufactured in a flat configuration as shown in FIG. 1, it may be more easily manufactured using well known injection molding techniques from various suitable materials. For example, the item protection device 10 may be manufactured out of a metal, fibrous composite or a plastic, such as high-density polyethylene (HDPE) or ADS/polyvinyl chloride (PVC) plastic.

Figure 2:
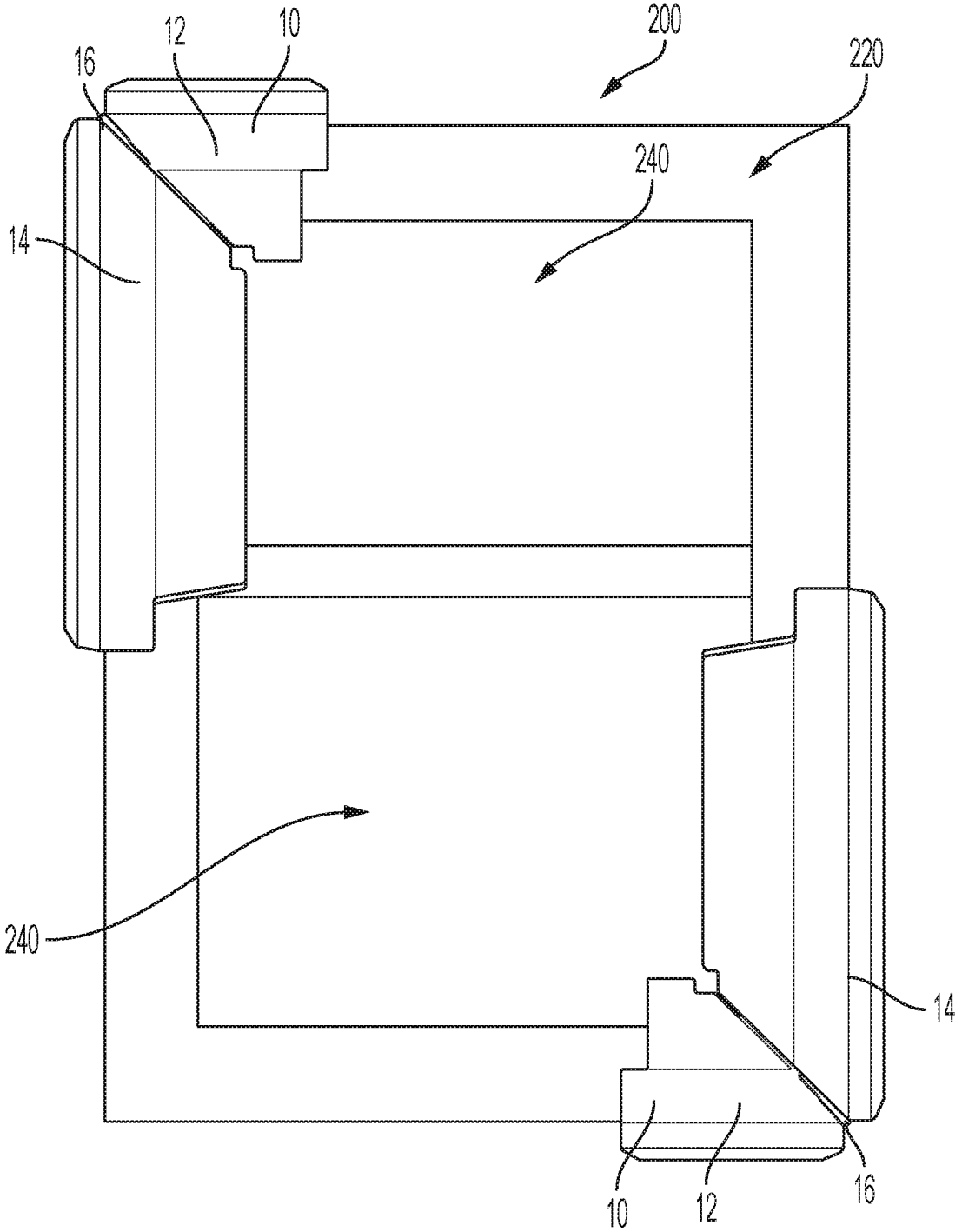
FIG. 2 illustrates two window unit protection devices installed on two corners of a window unit.

Each portion 12, 14 may have a first and/or a second tower portions 18, 20 adjacent each other with a valley region 19 in between the tower portions 18, 20. In the embodiment in which the item protection device 10 is being used to protect a window unit (as shown in FIG. 2), each of the tower portions 18, 20, when the item protecting device is installed on the window unit to protect the window unit, may rest against a frame of the window unit. The specific height, width and shape of each tower portion 18, 20 and the shape and depth of the valley region 19 may be varied. For example, in the window unit protection device example, the specific height, width and shape of each tower portion 18, 20 and the shape and depth of the valley region 19 may be varied to accommodate different window units manufactured by different manufacturers. Similarly, when the item protection device 10 is used to protect other items, the specific height, width and shape of each tower portion 18, 20 and the shape and depth of the valley region 19 may be varied to accommodate different shaped items and different item configurations.

In one embodiment, a top surface 26 of the tower portions 18 and/or 20 on the second portion 14 and/or 12 may have an adhesive material that may be adhered to the frame of the item when the item protection device 10 is installed. In one embodiment, the adhesive material may be well known double sided sticky tape or glue that both adheres to the top surface 26 of the tower portion(s) and the frame of the item being protected when installed.

The item protection device 10 may further include a locking mechanism that locks the first and second portions 12, 14 together when the first and second portions 12, 14 are folded towards each other. The locking mechanism may further comprise a male portion 22 on each tower portion 18, 20 of the first portion 12 and a female portion 24 on each tower portion 18, 20 of the second portion 12 and lock together when the first and second portions 12,14 are folded towards each other using the hinge portion 16 as described in more detail below.

FIG. 2 illustrates two window unit protection devices 10 installed on two corners of a window unit 200. The window unit 200 may be a window unit (fora new construction or a replacement window unit. The window unit may have a frame portion 220 and one or more panes 240 of material. As shown in FIG. 2, each item protection device 10 may protect a corner of the window unit 200 by folding the first and second portions 12, 14 towards each other using the hinge portion 16. In the example in FIG. 2, two corners of the window unit 200 have the item protection device 10 installed and secured to the corner. There may also be an item protection device on each other corner. The item protection device 10 may also be used to protect one or more flat sides of the window unit by leaving the item protection device in a flat configuration as shown in FIG. 1. Thus, the same item protection device may be used to protect both a corner of an item as well as a flat edge/surface of the item.

Figure 3:
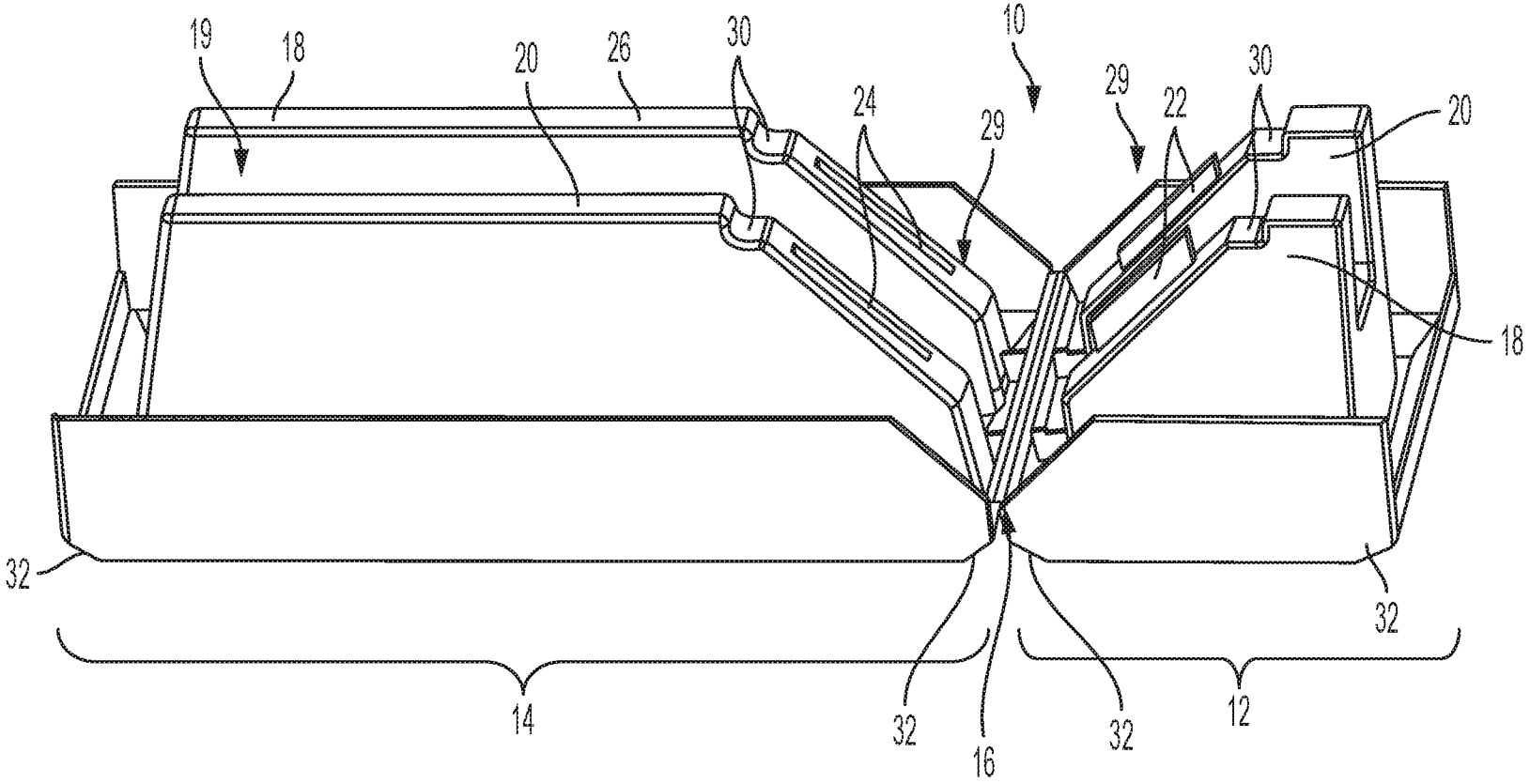
FIG. 3 is a side view of the item protection device.

FIG. 3 is a side view of the item protection device 10. FIG. 3 illustrates the male portions 22 and female portions 24 of the locking mechanism. In the example in FIG. 3, the male portion 22 on each tower 18, 20 of the first portion 12 extend out from the tower portion while each female portion 24 of on each tower 18, 20 of the first portion 14 is a void/hole/slot formed in each tower portion. Thus, when the first and second portions are folder towards each other for installation on a corner of the item, the respective male portion 22 slide into each respective female portion 24 and lock as described below. Also note that when the first and second portions 12,14 are folded towards each other, an angled region 29 of each tower portion of the first portion 12 and an angled region 29 of each second portion 14 rest against each other which further increases the strength and rigidity of the item protection device. Furthermore, for the item protection device being used to protect a window unit, each tower portion 18, 20 of each of the first and second portions 12, 14 may have a cutout region 30 at the top of the angled region 29. When the first and second portions 12,14 are folded towards each other, the cutout regions 30 end up adjacent to each other and form a channel to accommodate a feature in a window unit known as a plastic weld which may form a lump which requires additional clearance. A wood or metal window unit may have other features that may be accommodated by the channel formed by the cutout regions 30.

The item protection device 10 may further comprise a curved ramp region 32 at the corner of each of the first and second portions 12, 14. When the first and second portions 12,14 are folded together, such as to protect the corner of a window unit for example, the ramp regions 32 form a curved corner surface that slides more easily over rough surfaces. Furthermore, each end of each of the first and second portions 12, 14 distal from the hinge 16 may also have a ramp region 32 that slides more easily over rough surfaces.

Figure 4:
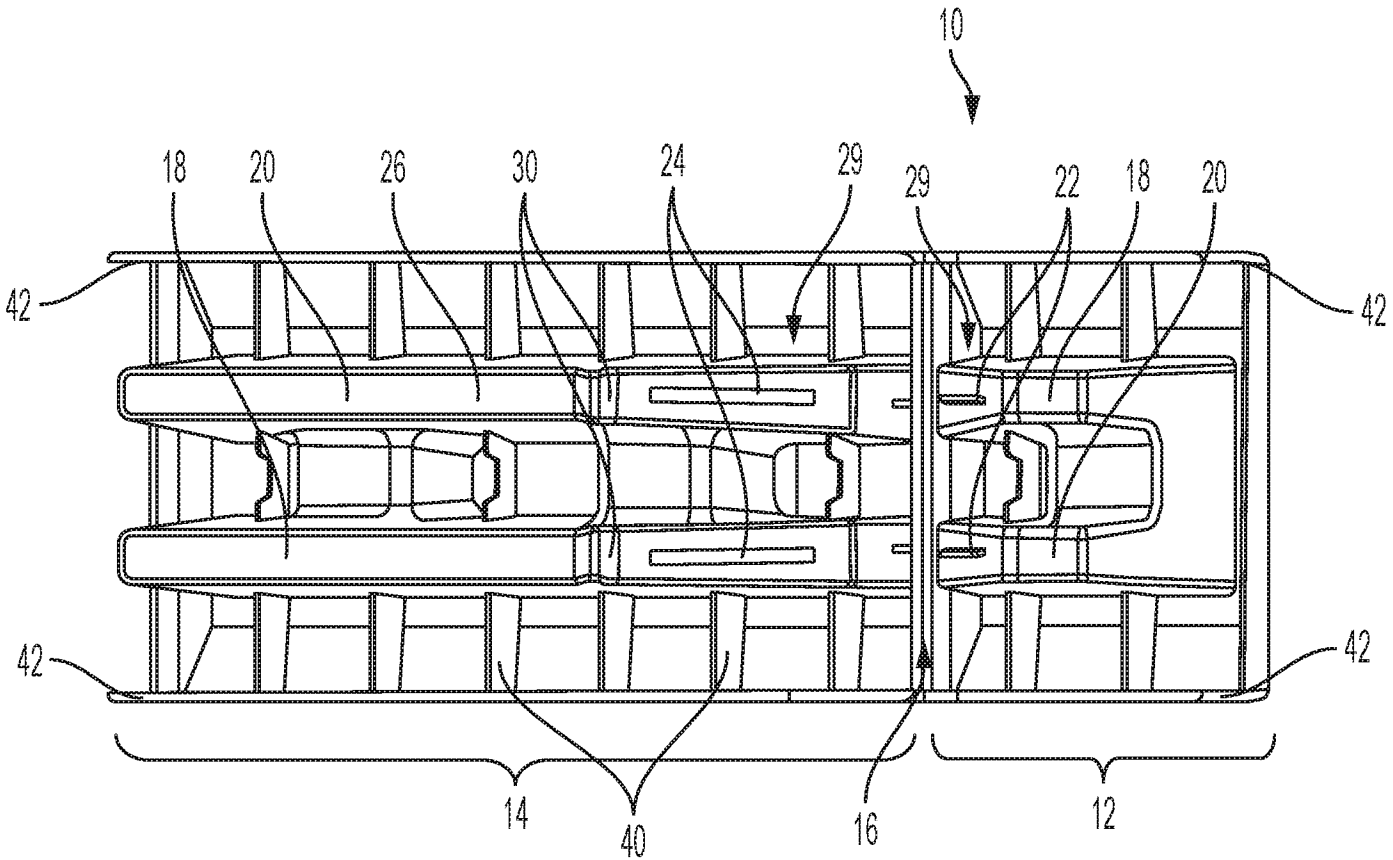
FIG. 4 is a top view of the item protection device.

FIG. 4 is a top view of the item protection device 10. As shown in FIG. 4, in some embodiments, the device 10 may have one or more wall portions 40 that increase the strength and structural rigidity of the part. The device 10 may further have side walls 42 that run along the long edge of each of the first and second portions 12,14 that protect an outer wall of the item, such as a frame of a window unit or a fin of a window, from side impact damage.

Figure 5:
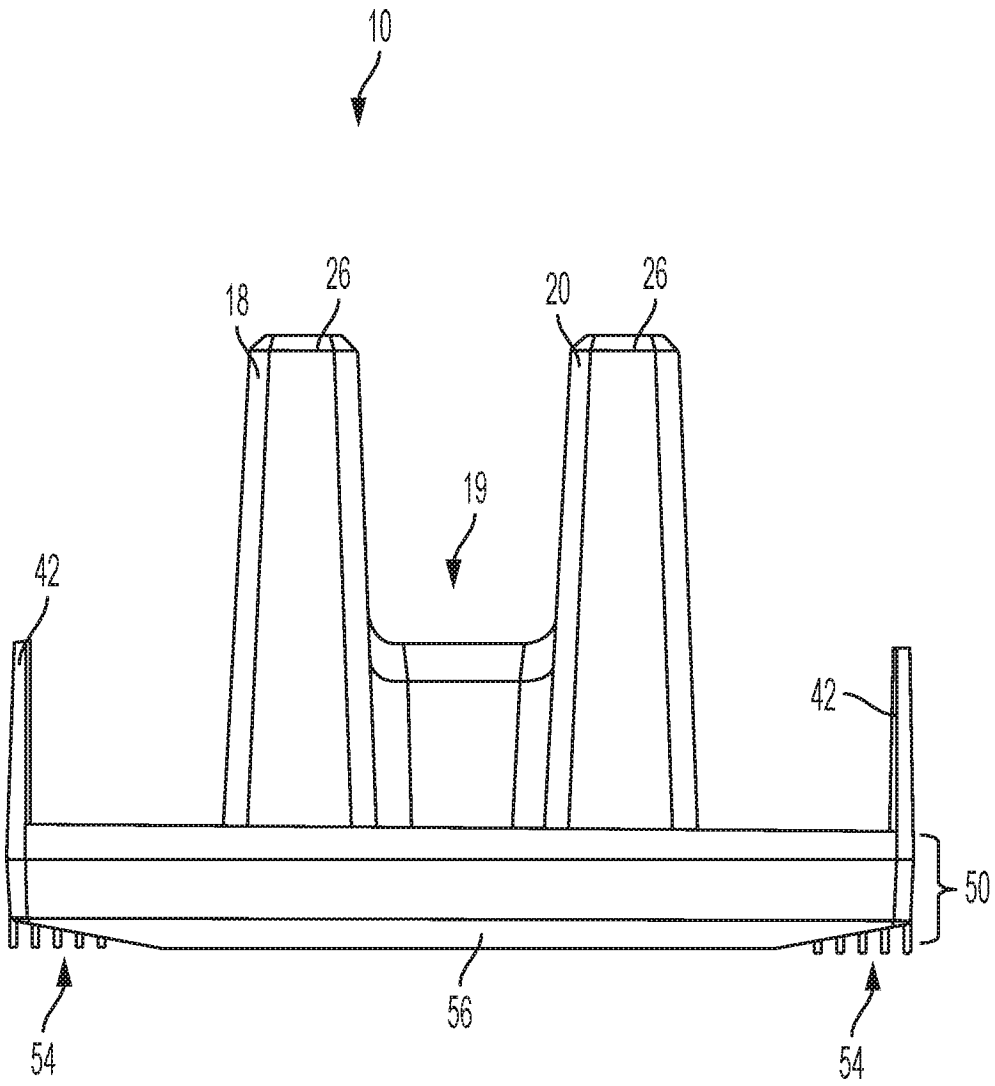
FIG. 5 is an end view of the item protection device.

FIG. 5 is an end view of the item protection device 10 for each of the first portion and second portion 12,14. The item protection device 10 has a bottom portion 50 to which the side walls 42 are formed. Each of the tower regions 18, 20 is also formed and connected to the bottom portion 50. The item protection device may further have one or more skid surfaces 56 (also shown in FIG. 6) that extend below the bottom region 50 so that an item with the installed item protection device may slide over imperfect surfaces without damage. The item protection device may also have a stabilizing region 54 at each side of the item protection device that permits the item protection device 10 to be tipped while affixed to the item while providing stability so that the item does not fall over. Furthermore, the stabilizing regions 54 may provide additional cushioning and a non-slip feature when installed on the item.

Figure 6:
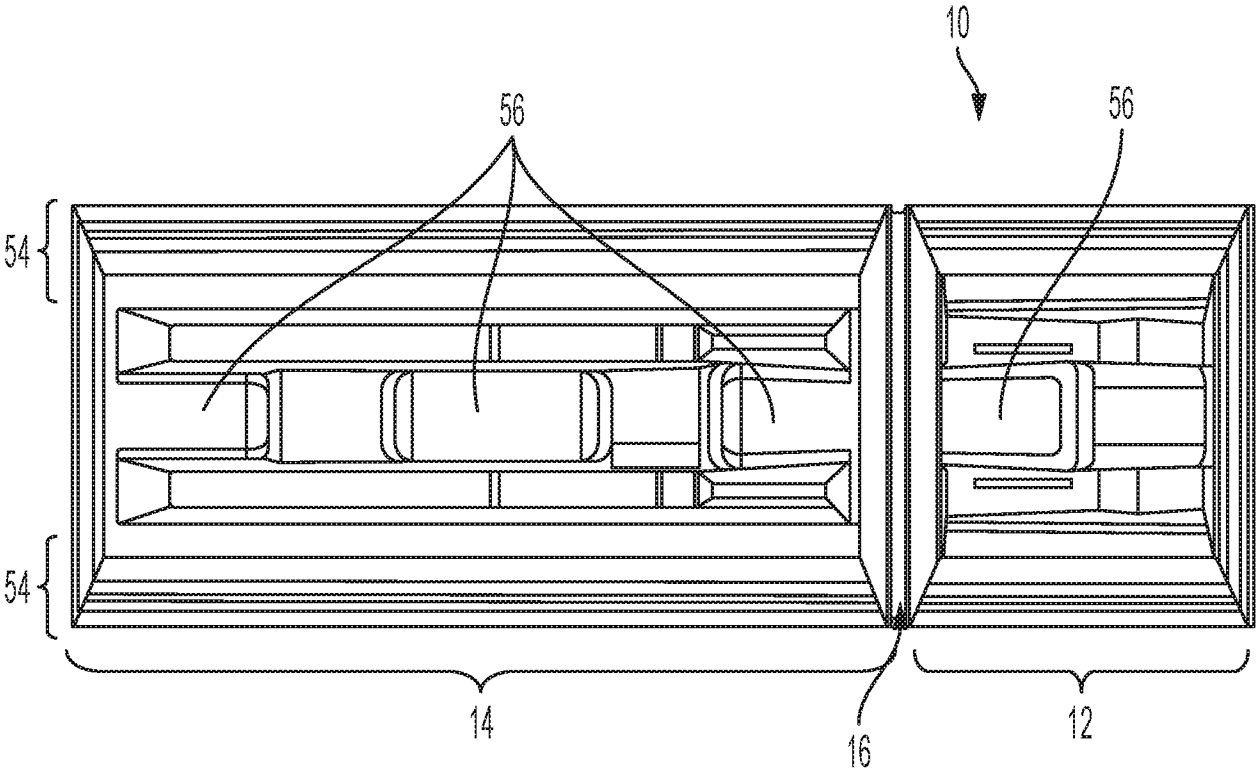
FIG. 6 is a bottom view of the item protection device.

In one embodiment shown in FIG. 5, each stabilizing region 54 may have one or more fins of varying length that form a flat surface with the skid surface 56 when the item is vertical (as shown in FIG. 5) but allows the items to be tipped/tilted. As shown in FIG. 6, each stabilizing region 54 may run along the long edge of the first portion 12 and the second portion 14 of the device 10.

Figure 7:
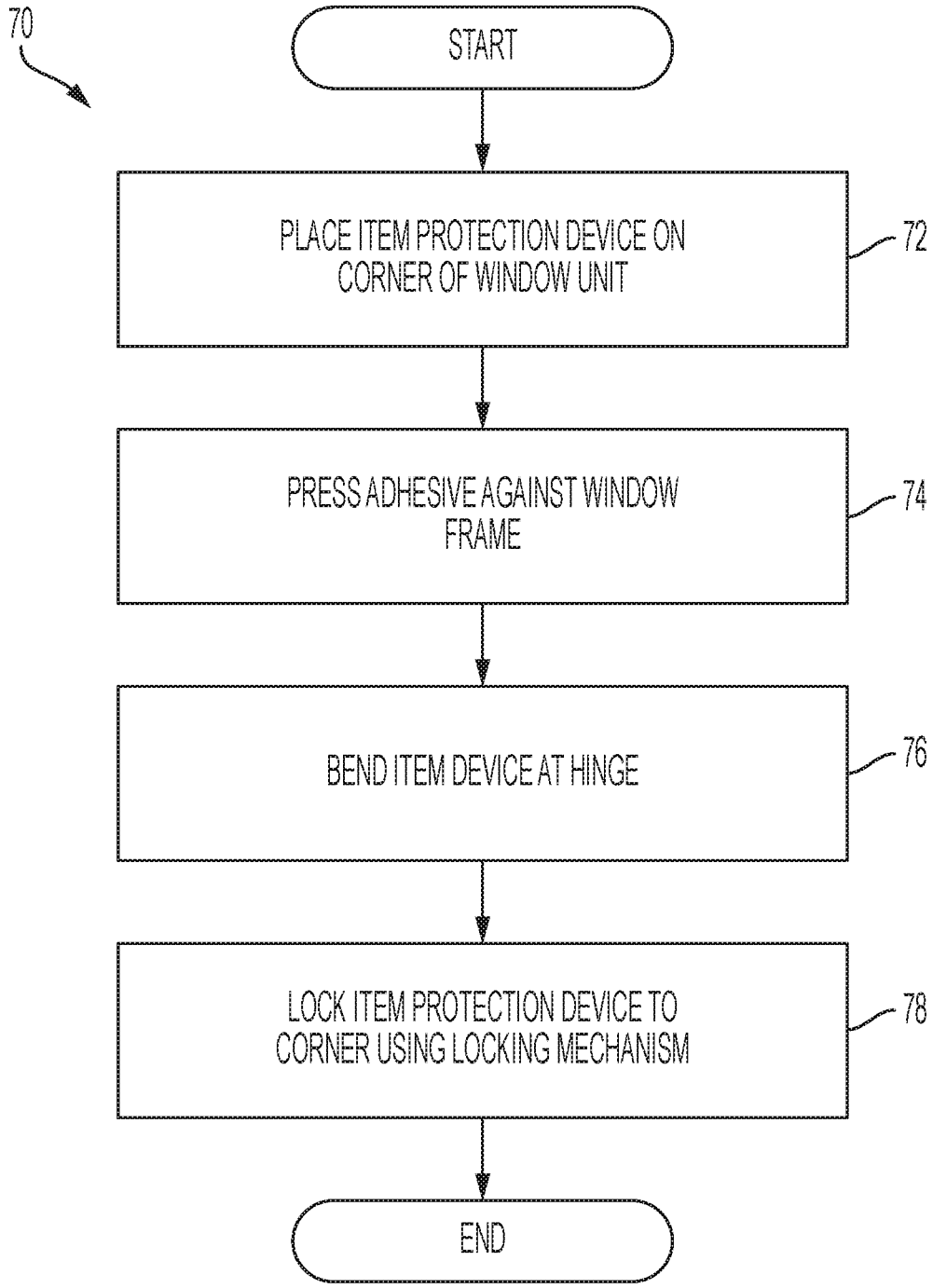
FIG. 7 illustrates a method for installing the item protection device on a corner of a window unit.

FIG. 7 illustrates a method 70 for installing the item protection device on a corner of a window unit. A user may take an item protection device and place it on a corner of a window unit (72). The adhesive of the second portion 14 of the item protection device 10 may be pressed against one side of the window frame (74) as shown in FIG. 2. The first portion 12 of the item protection device 10 may be bent towards second portion 14 relative to the hinge portion (76) so that the angled portions of the first and second portions come to rest against each other. At the same time, the item protection device is locked to the corner using the locking mechanism (78) so that the item protection device is not easily dislodged from the corner of the item during shipping, handling, moving and installation of the item. Alternatively, a user can bend the item protection device and lock it, remove the adhesive protector and then press the already locked item protection device onto a corner of the window unit.

Figure 8:
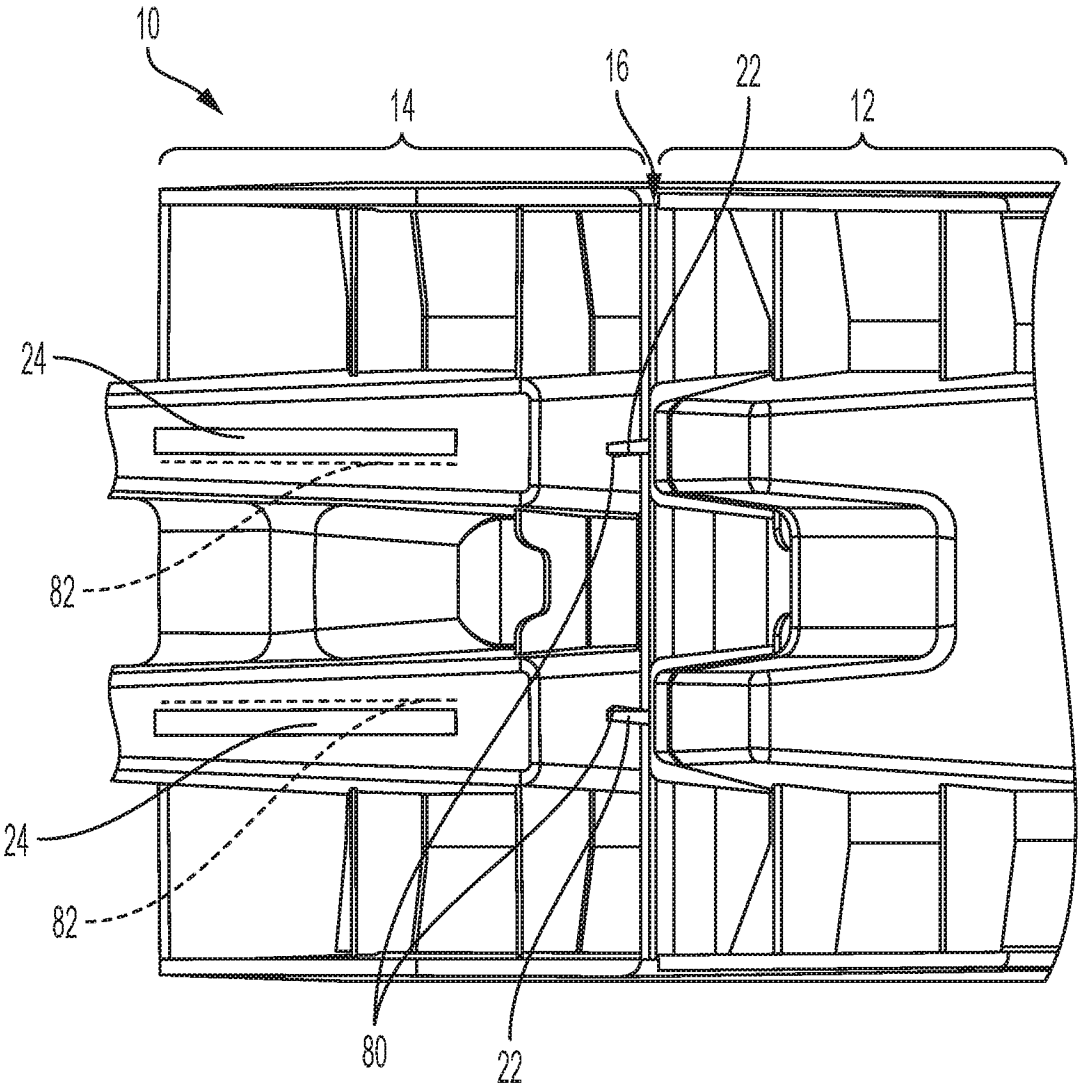
FIG. 8 illustrates more details of the locking mechanism of the item protection device.

FIG. 8 illustrates more details of the locking mechanism of the item protection device 10 that has the male portion 22 and the female portion. Each male portion 22 may further comprise a hook end 80 and each female portion 24 may have a ridge feature 82 (shown by the dotted lines in FIG. 8) beneath the top surface of the tower 18, 20. The hook end 80 of each male portion 22 may be face inwards towards each other (as shown in FIG. 8), but may also face outwards away from each other. The ridge feature 82 may be along an inner edge of the slot 24 as shown in FIG. 8, but may also be along the outer edge of the slot when hook ends 80 are used that face outwards.

In operation, when the male portion 22 and its hook end 80 go into the female portion 24, the ridge portions 82 engages the hook ends 80 to lock the two portions 12, 14 of the item protection device 10 together. In some embodiments, each hook end 80 may be slightly bent/angled (inwards or outwards depending on the embodiment) to create tension that assists the engagement of the hook end 80 by the ridge feature 82. In different embodiments for different items being protected, the height of the hook end 80 relative to a thickness of the overall item protection device 10 and the ridge feature 82 may be adjusted so as to engage tightly to maintain the desired angle of the item protection device 10 when locked. In the example shown in FIG. 8, that angle is 90 degrees. Furthermore, for different embodiments for different items being protected, the hook ends 80 and female portions 24 may be of any length and/or depth. The locking mechanism shown in FIG. 8 may be efficiently injection molded.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. The embodiments were chosen and described in order to best explain the principles of the disclosure and its practical applications, to thereby enable others skilled in the art to best utilize the disclosure and various embodiments with various modifications as are suited to the particular use contemplated.

Although certain presently preferred implementations of the invention have been specifically described herein, it will be apparent to those skilled in the art to which the invention pertains that variations and modifications of the various implementations shown and described herein may be made without departing from the spirit and scope of the invention. Accordingly, it is intended that the invention be limited only to the extent required by the applicable rules of law.

While the foregoing has been with reference to a particular embodiment of the disclosure, it will be appreciated by those skilled in the art that changes in this embodiment may be made without departing from the principles and spirit of the disclosure, the scope of which is defined by the appended claims.

The invention claimed is:

1. An item protection device, comprising:

a bottom portion having a stabilizing region on each side of the bottom portion adjacent a surface on which the item protection device rests;

a first portion and a second portion formed on the bottom portion being connected to each other by a hinge that allow the first and second portion to fold towards each other, wherein a bottom of each of the first portion and the second portion adjacent the hinge each further comprises a curved ramp region that form a curved corner surface when the first and second portions are folded together to slide an item in the item protection device over a rough surface;

the first portion having a first tower region and a second tower region extending upwards from the bottom portion that form a valley region having a length that extends lengthwise along a length of the first portion and a width between the first tower region and the second tower region;

the second portion having a third tower region and a fourth tower region that form a valley region having a length that extends lengthwise along a length of the second portion that is between the third tower region and the fourth tower region;

a locking member on the first portion and the second portion that is capable of locking the item protection device to an item when the first and second portions are folded towards each other and the first and second tower regions are adjacent each side of the item;

wherein each valley region has a bottom that is along the length of the first and second portions and above the bottom portion of the item protection device, wherein the bottom of each valley region supports a different side of the item; and wherein the first and second portions each have a cutout region that form a channel region when the first and second portions are folded together and each has a sidewall spaced apart from each tower region.

2. The device of claim 1, wherein the locking member further comprises a male portion formed on each of the first and second tower regions and a female portion formed on each of the third and fourth tower regions wherein each male portion is inserted into each female portion to lock the item protection device.

3. The device of claim 2, wherein each male portion further comprises a hook and each female portion further comprises a ridge feature and the hook engages the ridge feature to lock the item protection device.

4. The device of claim 1, wherein the width of the valley region is variable and a height of each tower region is variable.

5. The device of claim 1, wherein a top surface of the third and fourth tower regions has an adhesive that is capable of adhering to the item.

6. The device of claim 1, wherein a bottom surface of the first and second portions further comprises one or more skid surfaces formed on the bottom surface of the first and second portions.

7. The device of claim 1, wherein the stabilizing region further comprises a set of fins formed on the bottom portion.

8. The device of claim 6, wherein the item protection device is injection molded.

* * * * *